US007638990B1

(12) United States Patent
Shumarayev et al.

(10) Patent No.: US 7,638,990 B1
(45) Date of Patent: Dec. 29, 2009

(54) TECHNIQUES FOR POWER MANAGEMENT ON INTEGRATED CIRCUITS

(75) Inventors: Sergey Shumarayev, Los Altos Hills, CA (US); Simardeep Maangat, Sunnyvale, CA (US)

(73) Assignee: Altera Corporation, San Jose, CA (US)

( * ) Notice: Subject to any disclaimer, the term of this patent is extended or adjusted under 35 U.S.C. 154(b) by 239 days.

(21) Appl. No.: 11/754,295

(22) Filed: May 27, 2007

(51) Int. Cl.
*G05F 1/40* (2006.01)
*G05F 1/56* (2006.01)

(52) U.S. Cl. ..... 323/271; 323/282

(58) Field of Classification Search ..... 323/265, 323/266, 268, 271, 282, 283, 285, 349–351; 307/52, 70, 80, 85, 86
See application file for complete search history.

(56) References Cited

U.S. PATENT DOCUMENTS 5,757,225 A * 5/1998 Tobita ..... 327/539
6,249,112 B1 * 6/2001 Khouri et al. ..... 323/282
6,320,361 B2 * 11/2001 Dima et al. ..... 323/284
7,071,664 B1 * 7/2006 Teggatz et al. ..... 323/280
7,307,406 B2 * 12/2007 Shirai et al. ..... 323/285
7,372,245 B2 * 5/2008 Ito et al. ..... 323/316

OTHER PUBLICATIONS

U.S. Appl. No. 11/558,800, filed Nov. 10, 2006, Lai et al.
U.S. Appl. No. 11/622,396, filed Jan. 11, 2007, Shumarayev et al.

* cited by examiner

*Primary Examiner*—Matthew V Nguyen
(74) *Attorney, Agent, or Firm*—Steven J. Cahill

(57) ABSTRACT

A power management system on an integrated circuit can include a first switch and a second switch. A regulator circuit provides current from a first supply voltage to a circuit block when the first switch is closed. The second switch provides current from a second supply voltage to the circuit block when the second switch is closed.

19 Claims, 8 Drawing Sheets

TECHNIQUES FOR POWER MANAGEMENT ON INTEGRATED CIRCUITS

BACKGROUND OF THE INVENTION

The present invention relates to electronic circuits, and more particularly, to techniques for power management on integrated circuits.

Regulators with active filtration are commonly used on sensitive analog supply voltages. Regulators with active filtration enable multiple analog modules to share a common analog supply voltage without introducing noise to the supply voltage or picking up noise from the supply voltage.

In the Stratix® II GX field programmable gate array (FPGA) manufactured by Altera Corporation of San Jose, Calif., each transceiver channel, as well as each phase-locked loop, has an individual regulator. To provide headroom, each regulator operates from an elevated supply voltage, e.g., 3.3 volts.

In the Stratix® II GX, the 3.3 volt elevated supply voltage is shared among numerous analog circuits. Each analog circuit can be individually coupled to the supply voltage by closing a first switch that couples a gate of a transistor in an active regulator to the supply voltage, causing the transistor to turn on. When the transistor is on, current flows from the supply voltage to the analog circuit through the transistor. Each analog circuit can be individually decoupled from the supply voltage by opening the first switch and closing a second switch that couples the gate of the transistor in the active regulator circuit to ground.

However, the elevated supply voltage increases power consumption and requires the customer to supply a clear 3.3 volt power supply level, which is an added expense. This added expense can be a burden in a customer system that has a low data rate and that does not need to satisfy the high performance jitter requirements of 6 GHz transceiver. Therefore, it would be desirable to provide a system for managing supply voltages that provides more flexibility.

BRIEF SUMMARY OF THE INVENTION

According to some embodiments of the present invention, a power management system on an integrated circuit includes a first switch and a second switch. A regulator circuit provides current from a first supply voltage to a circuit block when the first switch is closed. The second switch provides current from a second supply voltage to the circuit block when the second switch is closed.

Other objects, features, and advantages of the present invention will become apparent upon consideration of the following detailed description and the accompanying drawings.

DETAILED DESCRIPTION OF THE INVENTION

Figure 1:
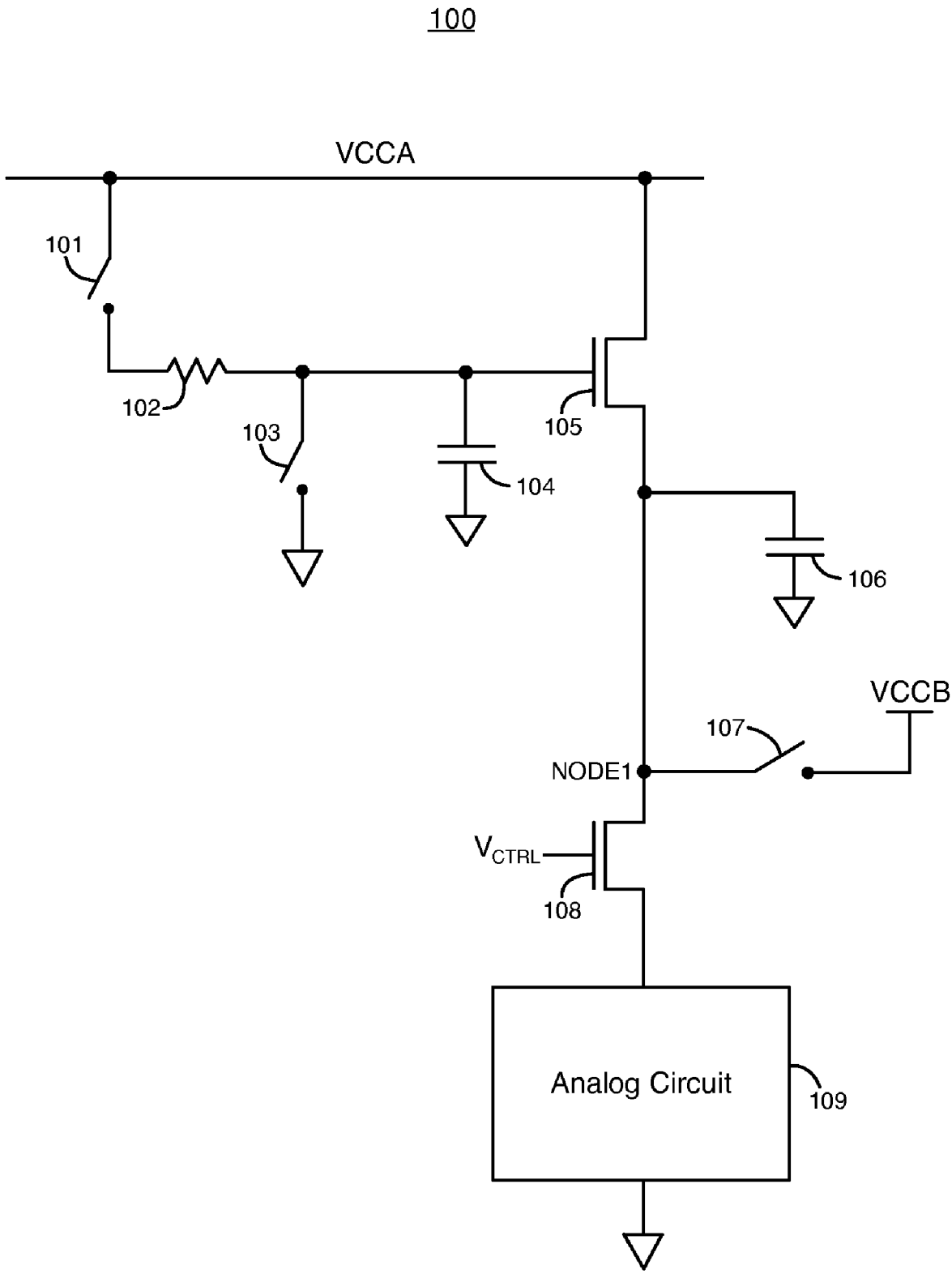
FIG. 1 illustrates a diagram of an analog power management system, according to an embodiment of the present invention.

FIG. 1 illustrates a diagram of an analog power management system 100, according to an embodiment of the present invention. Analog power management system 100 is configured to provide a first power supply voltage VCCA or a second power supply voltage VCCB to analog circuit 109.

Analog circuit 109 can be, for example, a voltage controlled oscillator, a charge pump, or a phase frequency detector in a phase-locked loop. Analog circuit 109 can also be another type of analog circuit, such as a transceiver. According to an alternative embodiment, analog circuit 109 can be replaced with a digital circuit block.

Analog power management system 100 includes a first switch 101, a second switch 103, and a third switch 107. Analog power management system 100 also includes a resistor 102, a first capacitor 104, a second capacitor 106, a first n-channel metal oxide semiconductor field-effect transistor (MOSFET) 105, and a second n-channel MOSFET 108. Resistor 102 can be implemented by one or more transistors. Each of the capacitors 104 and 106 can be implemented using one or more transistors. Transistors 105 and 108 can be, for example, thick oxide n-channel MOSFETs.

Analog power management system 100 can be fabricated in an integrated circuit such as a programmable logic integrated circuit. Programmable logic integrated circuits include, for example, field programmable gate arrays (FPGAs), programmable logic devices (PLDs), and programmable logic arrays (PLAs).

Switches 101, 103, and 107 are controlled by configuration signals. The configuration signals can be, for example, generated in response to configuration bits loaded into a programmable logic integrated circuit during configuration mode.

In a first configuration, analog power management system 100 transmits a first power supply voltage VCCA to analog circuit 109. In the first configuration, switch 101 is closed, switch 103 is open, and switch 107 is open. Charge flows from supply voltage VCCA through switch 101 and resistor 102 to the gate of n-channel transistor 105, causing transistor 105 to turn on and conduct current.

Supply voltage VCCA can be shared by numerous analog circuit blocks including analog circuit 109. Varying currents drawn by the numerous analog circuit blocks can cause high frequency fluctuations (i.e., noise) in supply voltage VCCA.

Resistor 102 and capacitor 104 form a low pass filter. The low pass filter attenuates high frequency noise from VCCA so that the voltage at the gate of transistor 105 is more stable.

Circuit elements 101-105 form a regulator with active filtration. The active filtration is performed by the low pass filter. The source current of transistor 105 is the output current of the regulator. The low pass filter reduces variations in the output current of the regulator that are caused by noise in VCCA. The low pass filter can, for example, have a low corner frequency. Transistor 105 can be driven into saturation when it is on to further reduce output current variations.

$V_{CTRL}$ is a control voltage that controls the current through transistor 108. The $V_{CTRL}$ voltage is generated by a control circuit (not shown). Because the gate of transistor 108 is coupled to a control voltage $V_{CTRL}$ that is not directly responsive to supply voltage VCCA, transistor 108 also attenuates noise in the supply voltage that is provided to analog circuit 109 from VCCA.

$V_{CTRL}$ can be, for example, the output voltage of a charge pump that is filtered by a low pass loop filter in a phase-locked loop. According to this example, analog circuit 109 and transistor 108 are a voltage-controlled oscillator (VCO) that generates periodic output signals having frequencies that vary in response to changes in voltage $V_{CTRL}$.

The drain of transistor 105 is coupled to VCCA. The source of transistor 105 is coupled to the drain of transistor 108 at NODE1. The source of transistor 108 is coupled to analog circuit 109. When transistors 105 and 108 are on, current flows from supply voltage VCCA through transistors 105 and 108 to analog circuit 109. In a VCO embodiment, the source current of transistor 108 can be routed to delay circuits coupled into a ring oscillator. The source voltage of transistor 108 provides a supply voltage for the delay circuits.

Transistor 108 and the regulator formed by circuits 101-105 significantly reduce fluctuations in the supply voltage received by analog circuit 109 at the source of transistor 108. This feature is particularly advantageous in power management systems that have a noisy shared power supply voltage VCCA. If analog circuit 109 is part of a phase-locked loop (PLL) circuit, the reduction in power supply voltage fluctuations can significantly improve the jitter performance of the PLL.

Circuitry inside analog circuit block 109 can cause variations in the voltage at the source of transistor 105 at NODE1. For example, changes in the amount of current drawn by analog circuit 109 can change the source voltage of transistor 105. Capacitor 106 attenuates fluctuations in source voltage of transistor 105 so that these variations have less of an effect on supply voltage VCCA.

In a second configuration, analog power management system 100 transmits a second power supply voltage VCCB to analog circuit 109. The second power supply voltage VCCB is typically less than the first power supply voltage VCCA, although in some embodiments, VCCB can be greater than VCCA. As an example, VCCA can be 2.5 or 3.3 volts, and VCCB can be 1.2 or 1.5 volts. These examples are not intended to limit the scope of the present invention.

In the second configuration, switch 101 is open, switch 103 is closed, and switch 107 is closed. When switch 101 is open, and switch 103 is closed, the gate of n-channel transistor 105 is coupled to ground through switch 103. As a result, transistor 105 is off and does not conduct current.

Switch 107 is coupled between VCCB and the drain of transistor 108 at NODE1. When switch 107 is closed, current flows from supply voltage VCCB through switch 107 and transistor 108 to analog circuit 109. Thus, in the second configuration, a supply voltage is provided to analog circuit 109 through transistor 108, bypassing the regulator formed by circuits 101-105.

If supply voltage VCCB is less than supply voltage VCCA, the second configuration can generate a significant power reduction relative to the first configuration. For example, if VCCA is 3.3 volts, and VCCB is 1.2 volts, then analog circuit 109 uses 2.75 times less power in the second configuration compared to the first configuration. However, analog circuit 109 generally functions more slowly in response to a smaller power supply voltage VCCB. For example, if analog circuit 109 is part of a transceiver circuit, the transceiver has a slower data rate when circuit 109 is coupled to VCCB.

Supply voltage VCCB can also be shared by multiple circuit blocks in addition to analog circuit 109. If VCCB is a shared supply voltage, VCCB may be noisier than VCCA, because regulator circuits 101-105 filter noise transmission between VCCA and circuit blocks that draw current from VCCA. The number of circuit blocks that draw current from VCCB can be less than the number of circuit blocks that draw current from VCCA. Alternatively, supply voltage VCCB can be an independent supply voltage that is provided just for the purpose of powering analog circuit 109.

In the second configuration, the supply voltage VCCB provided to analog circuit 109 is not filtered by the active filtration regulator formed by circuits 101-105. Transistor 108 provides some filtering of noise between VCCB and analog circuit 109, because transistor 108 is controlled by a control voltage $V_{CTRL}$ that is not directly responsive to VCCB. If analog circuit 109 needs additional filtering to generate signals that have a lower jitter, either VCCB can be a low noise supply voltage, or VCCB can be filtered by another filter circuit.

Figure 2:
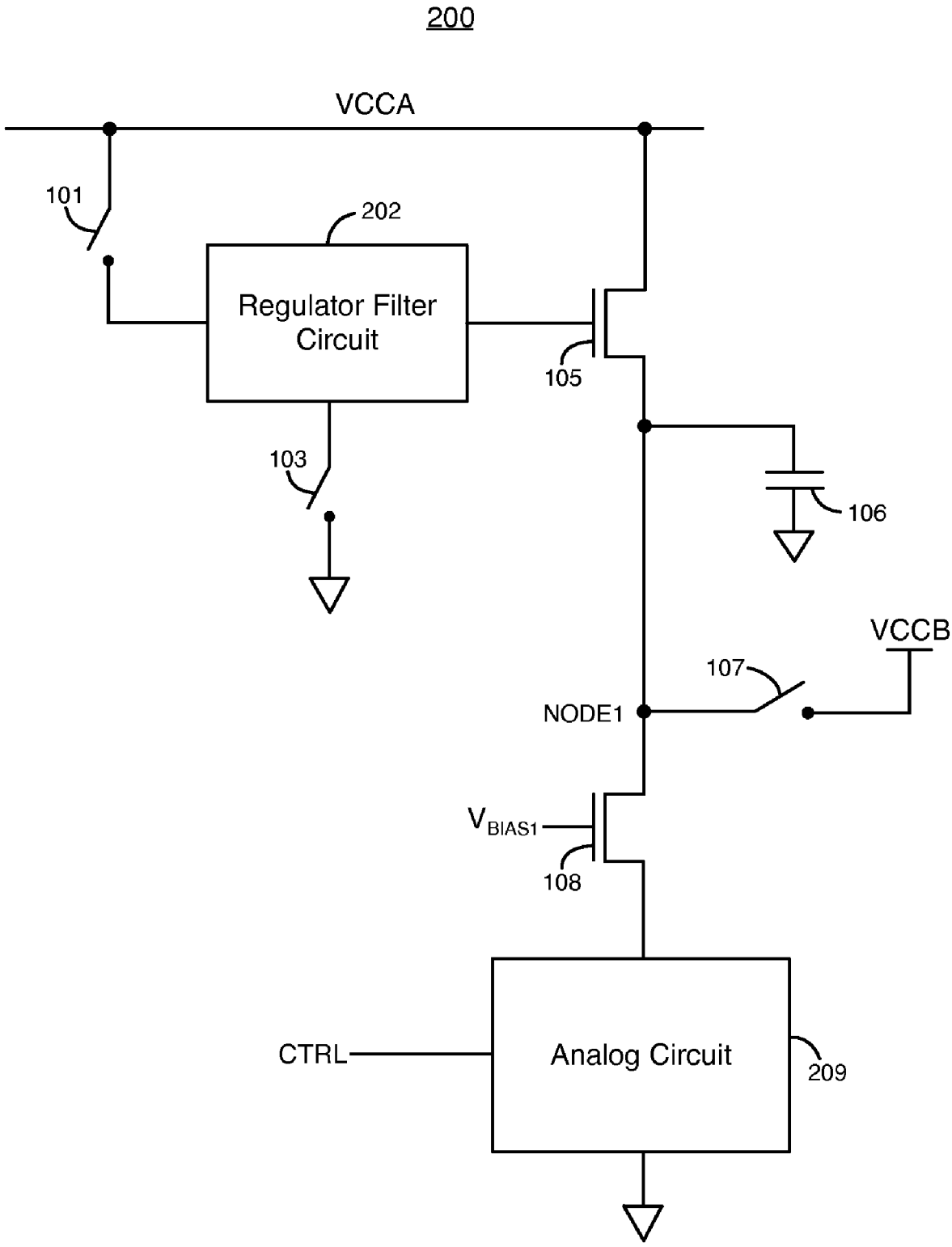
FIG. 2 illustrates a diagram of another analog power management system, according to an additional embodiment of the present invention.

FIG. 2 illustrates a diagram of another analog power management system 200, according to an additional embodiment of the present invention. Power management system 200 includes switch 101, regulator filter circuit 202, switch 103, n-channel MOSFET 105, capacitor 106, switch 107, n-channel MOSFET 108, and analog circuit 209.

Regulator filter circuit 202 can be any suitable type of regulator filter. For example, regulator filter circuit 202 can be a resistor/capacitor low pass filter as shown in FIG. 1. As another example, regulator filter circuit 202 can include an operational amplifier having an output coupled to the gate of n-channel transistor 105. According to an alternative embodiment, transistor 105 can be replaced with a p-channel MOSFET. Also, transistor 108 can be replaced with a p-channel MOSFET.

The gate of n-channel transistor 108 is coupled to receive a bias voltage $V_{BIAS1}$. Bias voltage $V_{BIAS1}$ has a constant voltage that keeps transistor 108 in saturation so that transistor 108 provides maximum attenuation of noise transmitted from supply voltages VCCA or VCCB to analog circuit 209.

An input control signal CTRL is transmitted directly to analog circuit 209. Control signal CTRL can be, for example, a control voltage or a control current. Alternatively, an input data signal can be provided to analog circuit 209 instead of an input control signal. According to an alternative embodiment, analog circuit 209 can be replaced with a digital circuit block.

In the first configuration of system 200, switch 101 is closed, and switches 103 and 107 are open. In the first configuration, transistors 105 and 108 are on, and current is drawn from VCCA to analog circuit 209 through transistors 105 and 108. Transistors 105 and 108 filter noise from VCCA, as described above.

In the second configuration of system 200, switch 101 is open, and switches 103 and 107 are closed. In the second configuration, transistor 105 is off, transistor 108 is on, and current is drawn from VCCB to analog circuit 209 through switch 107 and transistor 108. Transistor 108 provides some filtration of noise from VCCB.

Supply voltage VCCA is typically greater than supply voltage VCCB. Thus, analog circuit 209 can operate faster in the first configuration, but analog circuit 209 consumes less power in the second configuration.

Figure 3:
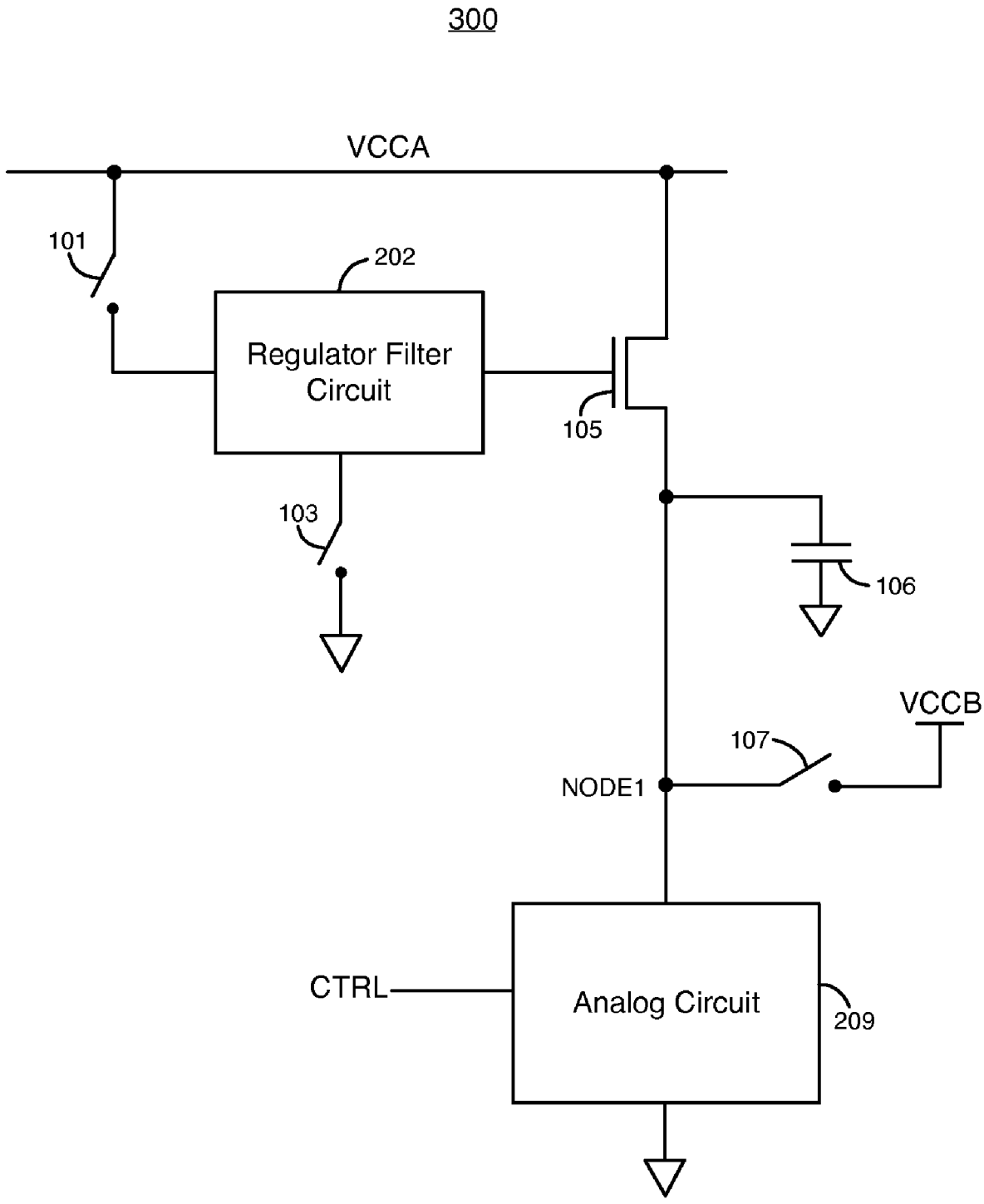
FIG. 3 illustrates a diagram of yet another analog power management system, according to an additional embodiment of the present invention.

FIG. 3 illustrates a diagram of another analog power management system 300, according to an additional embodiment of the present invention. Power management system 300 includes switch 101, regulator filter circuit 202, switch 103, n-channel MOSFET 105, capacitor 106, switch 107, and analog circuit 209.

In system 300, transistor 108 has been removed. Switch 107 is coupled between VCCB and analog circuit 209 at NODE1. Current is drawn from VCCA to analog circuit 209 through transistor 105 in the first configuration, and current is drawn from VCCB to analog circuit 209 through switch 107 in the second configuration.

An integrated circuit can, for example, have several power management systems 100, 200, and/or 300 that control the supply voltage provided to analog circuits and/or digital circuits. Analog circuit 109 or 209 can, for example, be part of a transceiver circuit that transmits or sends data. If voltage VCCA is greater than voltage VCCB, high data rate channels that include analog circuits 109 or 209 are preferably configured according to the first configuration so that the high data rate channels receive supply voltage VCCA. If VCCA is a relatively large supply voltage (e.g., 3.3 volts), then analog circuits 109 and 209 can function at a high data rate with a wide tuning range in the first configuration. On the other hand, low power/low data rate channels that include analog circuits 109 or 209 are preferably configured to receive supply voltage VCCB to reduce power consumption, according to the second configuration.

Noise in supply voltage VCCA tends to increase when many circuits draw current from VCCA. Noise in supply voltage VCCA can be reduced by decreasing the number of circuits that draw current from VCCA. The number of circuits that draw current from VCCA can be decreased by coupling some of analog circuits 109 and 209 on an integrated circuit to VCCB, according to the second configuration. By decreasing the total number of circuits that draw current from VCCA, jitter is reduced in the output signals of the high data rate circuits that receive supply voltage VCCA. Each data channel and each PLL on an integrated circuit can be configured to receive VCCA or VCCB according to their jitter, data rate, and power goals.

Figure 4:
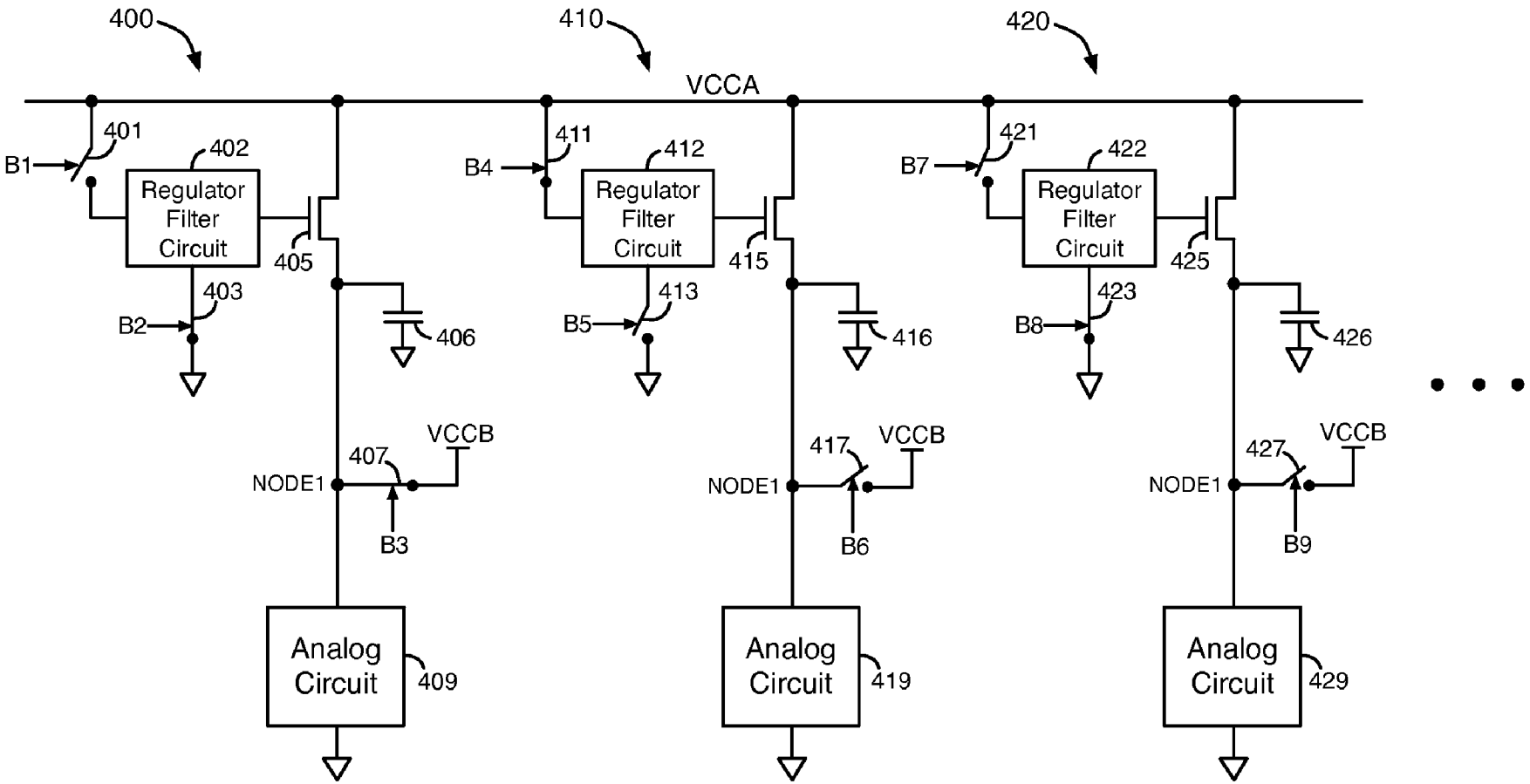
FIG. 4 illustrates an example of how power management systems can be individually configured, according to an embodiment of the present invention.

FIG. 4 illustrates an example of how power management systems on an integrated circuit can be individually configured, according to an embodiment of the present invention. Each of the power management systems 400, 410, and 420 shown in FIG. 4 (and other power management systems) can be individually configured by configuration signals to receive current from shared supply voltage VCCA or from supply voltage VCCB.

The configuration signals can couple power management systems 400, 410, 420, and other power management systems to receive different power supply voltages. Alternatively, one or more of the power management systems can be decoupled from both power supply voltages. The configuration signals can, for example, be derived from configuration bits that are loaded into an FPGA or PLD during configuration mode or user mode.

Power management system 400 includes regulator filter circuit 402, transistor 405, capacitor 406, analog circuit 409, and switches 401, 403, and 407. Switches 401, 403, and 407 are controlled by configuration signals B1, B2 and B3, respectively. In the example shown in FIG. 4, signal B1 is in a state that opens switch 401, signal B2 is in a state that closes switch 403, and signal B3 is in a state that closes switch 407. As a result, analog circuit 409 draws current from supply voltage VCCB through switch 407.

Power management system 410 includes regulator filter circuit 412, transistor 415, capacitor 416, analog circuit 419, and switches 411, 413, and 417. Switches 411, 413, and 417 are controlled by configuration signals B4, B5, and B6, respectively. In the example shown in FIG. 4, signal B4 is in a state that closes switch 411, signal B5 is in a state that opens switch 413, and signal B6 is in a state that opens switch 417. As a result, analog circuit 419 draws current from shared supply voltage VCCA through transistor 415.

Power management system 420 includes regulator filter circuit 422, transistor 425, capacitor 426, analog circuit 429, and switches 421, 423, and 427. Switches 421, 423, and 427 are controlled by configuration signals B7, B8, and B9, respectively. In the example shown in FIG. 4, signal B7 is in a state that opens switch 421, signal B8 is in a state that closes switch 423, and signal B9 is in a state that opens switch 427. As a result, analog circuit 429 does not receive current from VCCA or from VCCB.

According to alternative embodiments, one or more of analog circuits 409, 419, and 429 can be replaced with a digital circuit. According to another embodiment, switches 407, 417, and 427 in power management systems 400, 410, and 420 can couple three different power supply voltages VCCB, VCCC, and VCCD to circuits 409, 419, and 429, respectively.

Figure 5A:
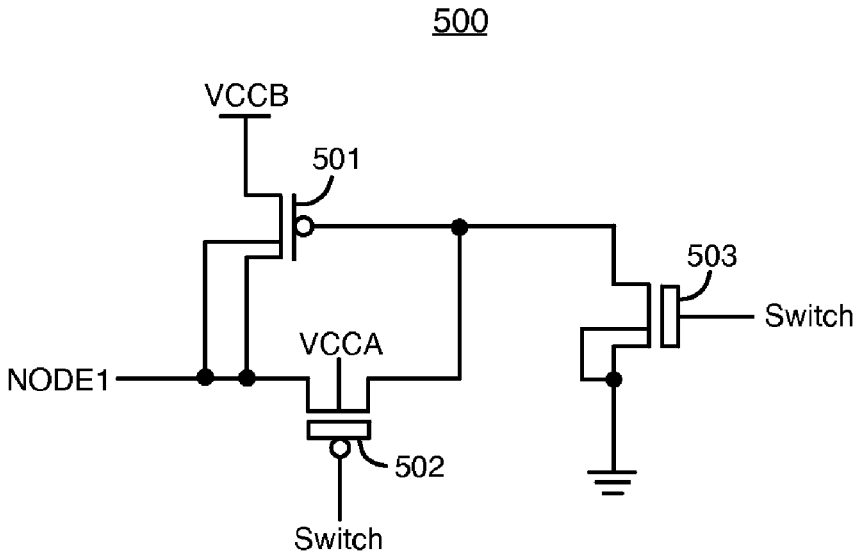
FIGS. 5A-5E illustrate examples of switches that can be used in power management systems, according to various embodiments of the present invention.

FIG. 5A illustrates a first example of a switch 500 that can be used to implement switches 107, 407, 417, or 427, according an embodiment of the present invention. Switch 500 includes p-channel MOSFETs 501 and 502 and n-channel MOSFET 503. Transistor 502 is coupled between the gate and the drain of transistor 501. The drain of transistor 503 is coupled to the gate of transistor 501 and a terminal of transistor 502. The drain and bulk of transistor 501 are coupled to NODE1. The source and bulk of transistor 503 are coupled to ground. The bulk of transistor 502 is coupled to VCCA (e.g., 3 volts). NODE1 in FIGS. 5A-5E is the same NODE1 shown in FIGS. 1-4.

Transistor 502 is a thick oxide p-channel MOSFET. Transistor 503 is a thick oxide n-channel MOSFET. Transistor 501 can be, for example, a thin oxide p-channel MOSFET.

The gates of transistors 502 and 503 are coupled to receive a Switch signal. The Switch signal is a configuration signal that controls the switching of transistors 502 and 503. The Switch signal can be toggled between VCCA (e.g., 3 volts) and ground to open and close switch 500.

When the Switch signal equals VCCA, transistor 503 is on, and transistor 502 is off. When transistor 503 is on, the gate of transistor 501 is coupled to ground. As a result, p-channel transistor 501 is on, and current flows from VCCB to NODE1 through transistor 501. Thus, switch 500 is on (i.e., closed) when the Switch signal equals VCCA.

When the Switch signal equals the ground voltage, transistor 503 is off. When the power management system is in the first configuration, current flows from NODE1 through transistor 502 to the gate of transistor 501. The threshold voltage of transistor 501 is referred to as $V_{T501}$. When the gate voltage of transistor 501 increases above VCCB-$V_{T501}$, transistor 501 turns off. Thus, switch 500 is off (i.e., open) when the Switch signal equals ground.

Figure 5B:
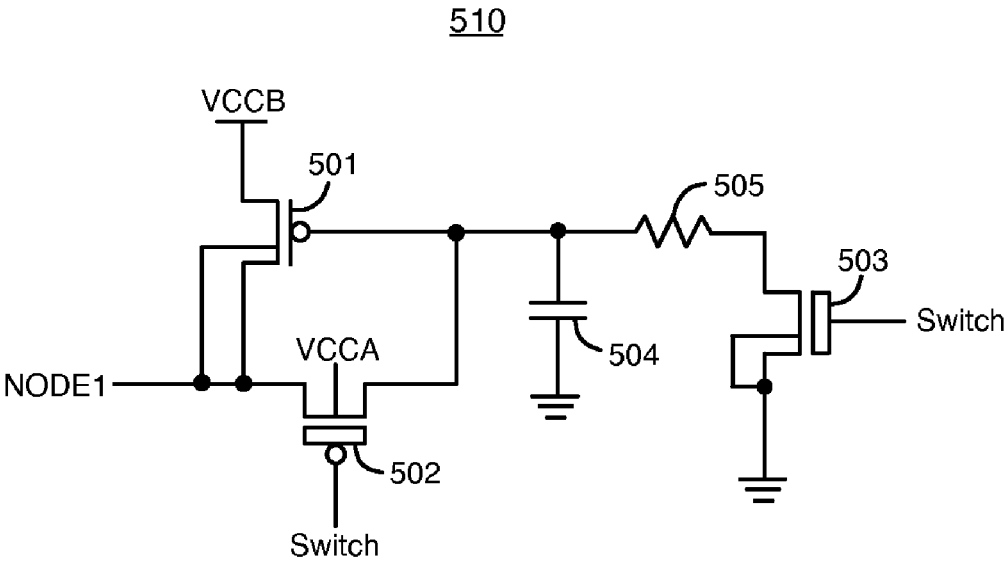

FIG. 5B illustrates a second example of a switch 510 that can be used to implement switches 107, 407, 417, or 427, according another embodiment of the present invention. Switch 510 includes p-channel MOSFETs 501 and 502, n-channel MOSFET 503, capacitor 504, and resistor 505.

Capacitor 504 and resistor 505 form a low pass filter. The low pass filter attenuates high frequency noise at the gate of transistor 501. For example, in switch 500 in FIG. 5A, the gate voltage of transistor 501 can vary when transistor 503 is on in response to noise in the ground voltage. Noise in the gate voltage of transistor 501 can cause the current through transistor 501 to vary when switch 500 is closed. In switch 510, the low pass filter formed by capacitor 504 and resistor 505 reduces variations in the current through transistor 501. Switch 510 opens and closes as described above with respect to switch 500.

Figure 5C:
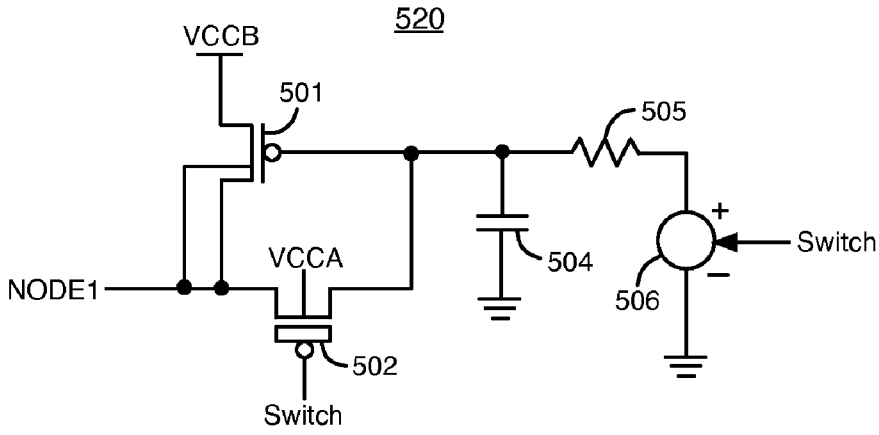

FIG. 5C illustrates a third example of a switch 520 that can be used to implement switches 107, 407, 417, or 427, according to a further embodiment of the present invention. Switch 520 includes p-channel MOSFETs 501 and 502, capacitor 504, resistor 505, and voltage source 506.

In switch 520, the gate of p-channel transistor 501 is coupled to voltage source 506 through resistor 505. Voltage source 506 generates a variable voltage. The Switch signal controls the voltage of voltage source 506.

When the Switch signal is in a first logic state, voltage source 506 generates a bias voltage $V_{BIAS2}$ that causes p-channel transistor 501 to turn on. When transistor 501 is on, switch 520 is closed. The bias voltage $V_{BIAS2}$ can be selected to be a voltage that puts transistor 501 in saturation to boost the power supply rejection ratio from the VCCB supply voltage. When the Switch signal is in a second logic state, voltage source 506 pulls the gate voltage of 501 to VCCB, which causes transistor 501 to turn off. When transistor 501 is off, switch 520 is open.

Figure 5D:
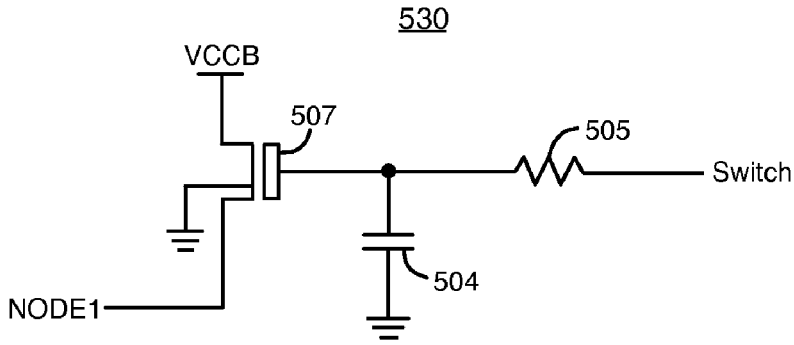

FIG. 5D illustrates a fourth example of a switch 530 that can be used to implement switches 107, 407, 417, or 427, according to another embodiment of the present invention. Switch 530 includes capacitor 504, resistor 505, and an n-channel MOSFET 507. Transistor 507 is a thick oxide MOSFET. The gate of transistor 507 is coupled to receive the Switch signal through resistor 505. The bulk of transistor 507 is coupled to ground.

The Switch signal is pulled low (e.g., ground) to turn off transistor 507 and to open switch 530. The Switch signal is pulled high (e.g., VCCA or VCCB) to turn on transistor 507 and to close switch 530. Capacitor 504 and resistor 505 form a low pass filter that attenuates high frequency noise from the Switch signal at the gate of transistor 507.

Figure 5E:
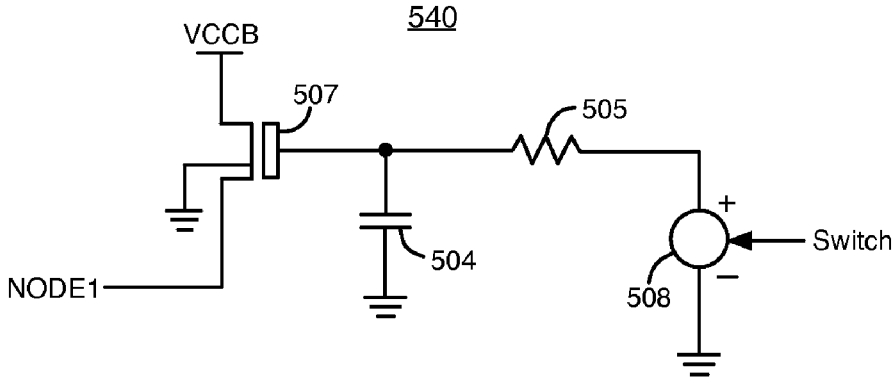

FIG. 5E illustrates a fifth example of a switch 540 that can be used to implement switches 107, 407, 417, or 427, according to another embodiment of the present invention. Switch 540 includes capacitor 504, resistor 505, n-channel MOSFET 507, and voltage source 508. Voltage source 508 generates a variable voltage. The Switch signal controls the voltage of voltage source 508.

When the Switch signal is in a first logic state, the voltage of voltage source 508 increases to a voltage $V_{BIAS3}$ that causes transistor 507 to turn on. $V_{BIAS3}$ can be selected to be a voltage other than VCCA that puts transistor 507 in saturation to boost the power supply rejection ratio from VCCB. For example, $V_{BIAS3}$ can be selected to be a transistor threshold voltage above VCCB. As a specific example, $V_{BIAS3}$ can be 1.8 volts if the threshold voltage of thick oxide transistor 507 is 0.6 volts, and VCCB equals 1.2 volts. When the Switch signal is in a second logic state, the voltage of voltage source 508 is pulled to ground, which causes transistor 507 to turn off.

According to a preferred embodiment of switches 500, 510, 520, 530, and 540, the voltage at NODE1 is restricted to a limited range (e.g., from 1.5 to 2.1 volts) in the first configuration when current flows through transistor 105 from VCCA. Restricting the voltage at NODE1 to a limited range eliminates overstress and forward biasing issues in transistors 501, 502, and 507.

The switches shown in FIGS. 5A-5E are merely examples that are not intended to limit the scope of the present invention. Many other types of switches can be used to implement switches 107, 407, 417, and 427.

Figure 6:
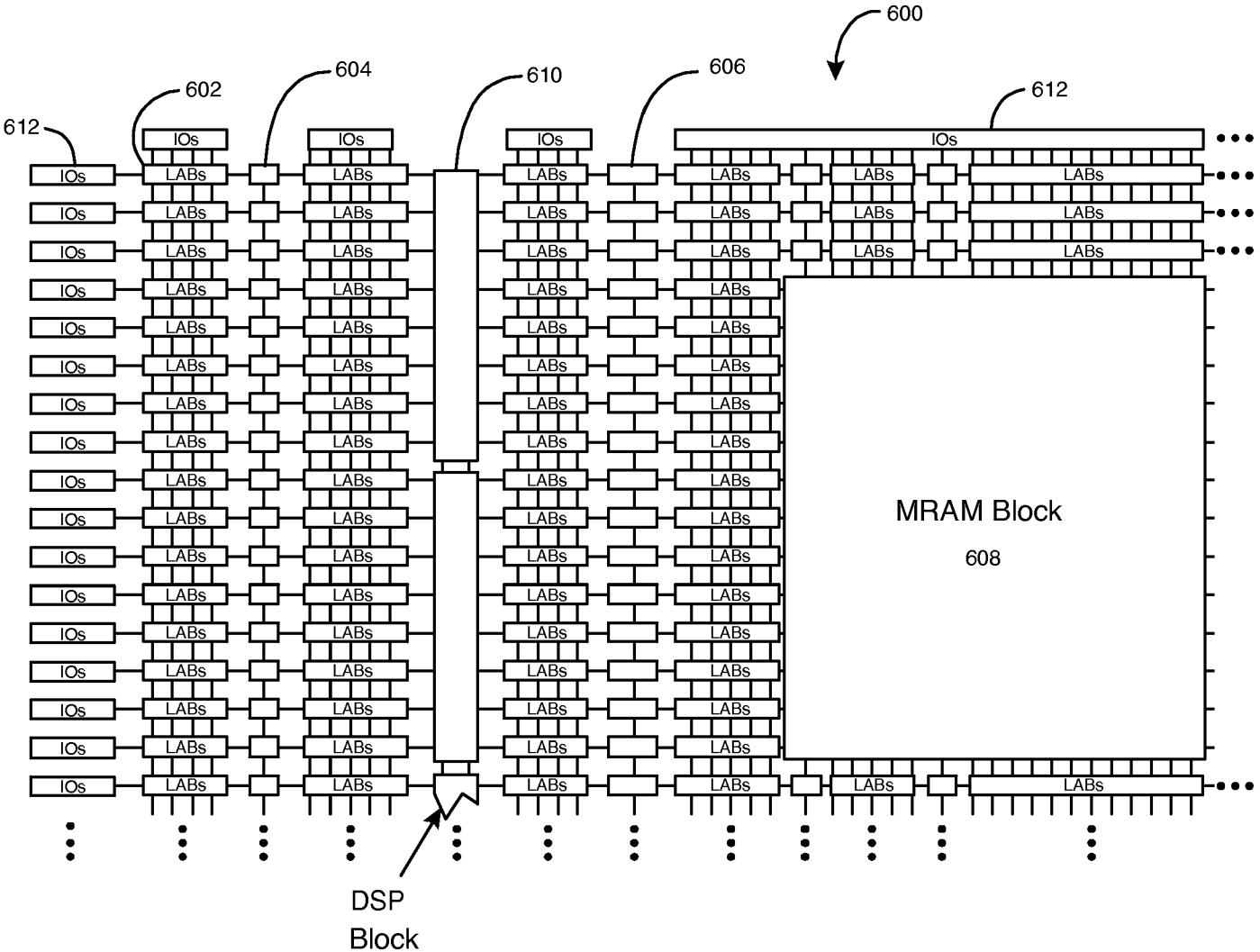
FIG. 6 is a simplified block diagram of a field programmable gate array (FPGA) that can embody techniques of the present invention.

FIG. 6 is a simplified partial block diagram of an FPGA 600 that can include aspects of the present invention. FPGA 600 is merely one example of an integrated circuit that can include features of the present invention. It should be understood that embodiments of the present invention can be used in numerous types of integrated circuits such as field programmable gate arrays (FPGAs), programmable logic devices (PLDs), complex programmable logic devices (CPLDs), programmable logic arrays (PLAs), and application specific integrated circuits (ASICs).

FPGA 600 includes a two-dimensional array of programmable logic array blocks (or LABs) 602 that are interconnected by a network of column and row interconnect conductors of varying length and speed. LABs 602 include multiple (e.g., 10) logic elements (or LEs).

An LE is a programmable logic block that provides for efficient implementation of user defined logic functions. An FPGA has numerous logic elements that can be configured to implement various combinatorial and sequential functions. The logic elements have access to a programmable interconnect structure. The programmable interconnect structure can be programmed to interconnect the logic elements in almost any desired configuration.

FPGA 600 also includes a distributed memory structure including RAM blocks of varying sizes provided throughout the array. The RAM blocks include, for example, blocks 604, blocks 606, and block 608. These memory blocks can also include shift registers and FIFO buffers.

FPGA 600 further includes digital signal processing (DSP) blocks 610 that can implement, for example, multipliers with add or subtract features. IO blocks (IOs) 612 located, in this example, around the periphery of the chip support numerous single-ended and differential input/output standards. The IO blocks 612 contain IO buffers and are typically grouped into IO banks. It is to be understood that FPGA 600 is described herein for illustrative purposes only and that the present invention can be implemented in many different types of PLDs, FPGAs, and the like.

Figure 7:
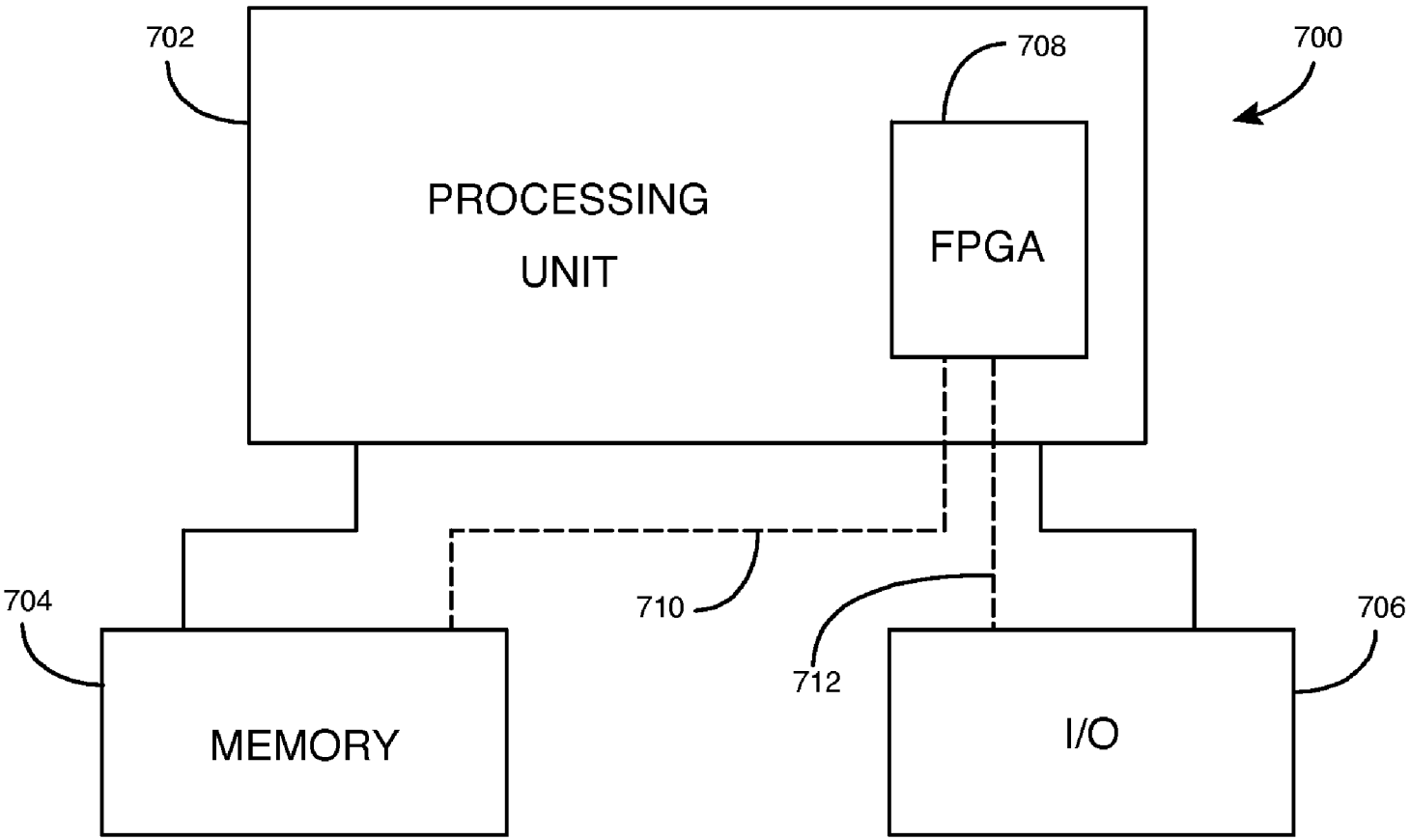
FIG. 7 is a block diagram of an electronic system that can implement embodiments of the present invention.

The present invention can also be implemented in a system that has an FPGA as one of several components. FIG. 7 shows a block diagram of an exemplary digital system 700 that can embody techniques of the present invention. System 700 can be a programmed digital computer system, digital signal processing system, specialized digital switching network, or other processing system. Moreover, such systems can be designed for a wide variety of applications such as telecommunications systems, automotive systems, control systems, consumer electronics, personal computers, Internet communications and networking, and others. Further, system 700 can be provided on a single board, on multiple boards, or within multiple enclosures.

System 700 includes a processing unit 702, a memory unit 704, and an I/O unit 706 interconnected together by one or more buses. According to this exemplary embodiment, an FPGA 708 is embedded in processing unit 702. FPGA 708 can serve many different purposes within the system in FIG. 7. FPGA 708 can, for example, be a logical building block of processing unit 702, supporting its internal and external operations. FPGA 708 is programmed to implement the logical functions necessary to carry on its particular role in system operation. FPGA 708 can be specially coupled to memory 704 through connection 710 and to I/O unit 706 through connection 712.

Processing unit 702 can direct data to an appropriate system component for processing or storage, execute a program stored in memory 704 or receive and transmit data via I/O unit 706, or other similar function. Processing unit 702 can be a central processing unit (CPU), microprocessor, floating point coprocessor, graphics coprocessor, hardware controller, microcontroller, field programmable gate array programmed for use as a controller, network controller, or any type of processor or controller. Furthermore, in many embodiments, there is often no need for a CPU.

For example, instead of a CPU, one or more FPGAs 708 can control the logical operations of the system. As another example, FPGA 708 acts as a reconfigurable processor, which can be reprogrammed as needed to handle a particular computing task. Alternately, FPGA 708 can itself include an embedded microprocessor. Memory unit 704 can be a random access memory (RAM), read only memory (ROM), fixed or flexible disk media, flash memory, tape, or any other storage means, or any combination of these storage means.

The foregoing description of the exemplary embodiments of the present invention has been presented for the purposes of illustration and description. It is not intended to be exhaustive or to limit the present invention to the examples disclosed herein. A latitude of modification, various changes, and substitutions are intended in the present invention. In some instances, features of the present invention can be employed without a corresponding use of other features as set forth. Many modifications and variations are possible in light of the above teachings, without departing from the scope of the present invention. It is not intended that the scope of the present invention be limited with this detailed description.

The invention claimed is:

1. A power management system on an integrated circuit comprising:

a first switch;

a first circuit block;

a first regulator circuit coupled to receive a first supply voltage and providing current from the first supply voltage to the first circuit block when the first switch is closed;

a first transistor coupled between the first regulator circuit and the first circuit block; and a second switch coupled to the first transistor, wherein the second switch receives a second supply voltage and provides current from the second supply voltage to the first circuit block when the second switch is closed.

2. The power management system defined in claim 1 wherein the first circuit block is an analog circuit.

3. The power management system defined in claim 2 wherein a state of the first switch is controlled by a first configuration signal, and a state of the second switch is controlled by a second configuration signal.

4. The power management system defined in claim 3 wherein the integrated circuit is a programmable logic integrated circuit, and wherein the first and the second configuration signals are generated in response to configuration bits that are loaded into the programmable logic integrated circuit.

5. The power management system defined in claim 1 wherein the first regulator circuit comprises a second transistor coupled between the first supply voltage and the first transistor.

6. The power management system defined in claim 5 further comprising:

a third switch coupled between the second transistor and a low voltage.

7. The power management system defined in claim 1 wherein the first supply voltage is a shared supply voltage, and the second supply voltage is less than the first supply voltage.

8. The power management system defined in claim 1 further comprising:

a third switch;

a second circuit block;

a second regulator circuit coupled to receive the first supply voltage and providing current from the first supply voltage to the second circuit block when the third switch is closed;

a second transistor coupled between the second regulator circuit and the second circuit block; and a fourth switch coupled to receive the second supply voltage and providing current from the second supply voltage to the second circuit block when the fourth switch is closed.

9. A power management system on an integrated circuit comprising:

a first switch;

a first circuit block;

a first regulator circuit coupled to receive a first supply voltage and providing current from the first supply voltage to the first circuit block when the first switch is closed; and a second switch coupled to receive a second supply voltage and providing current from the second supply voltage to the first circuit block when the second switch is closed, wherein the second switch comprises a first transistor coupled to receive the second supply voltage, and a second transistor coupled to a terminal of the first transistor.

10. A power management system on an integrated circuit comprising:

a first switch;

a first circuit block;

a first regulator circuit coupled to receive a first supply voltage and providing current from the first supply voltage to the first circuit block when the first switch is closed; and a second switch coupled to receive a second supply voltage and providing current from the second supply voltage to the first circuit block when the second switch is closed, wherein the second switch comprises a transistor having a terminal coupled to receive the second supply voltage and a control input coupled to receive a variable control signal.

11. A power management system on an integrated circuit comprising:

a first switch;

a first circuit block;

a first regulator circuit coupled to receive a first supply voltage and providing current from the first supply voltage to the first circuit block when the first switch is closed; and a second switch coupled to receive a second supply voltage and providing current from the second supply voltage to the first circuit block when the second switch is closed, wherein the second switch comprises a transistor having a terminal coupled to receive the second supply voltage and a control input coupled to a low pass filter.

12. A method for managing power on an integrated circuit, the method comprising:

closing a first switch to couple a regulator circuit to a node at a first supply voltage so that the regulator circuit provides current from the first supply voltage to a circuit block, wherein a second switch is open while the first switch is closed;

closing the second switch to provide current from a second supply voltage to the circuit block, wherein the first switch is open while the second switch is closed; and closing a third switch to turn off a transistor in the regulator circuit while the first switch is open.

13. The method defined in claim 12 wherein closing a first switch to couple a regulator circuit to a node at a first supply voltage further comprises providing charge from the first supply voltage through the first switch to a control input of a transistor in the regulator circuit that provides current from the first supply voltage to the circuit block.

14. A system for managing supply voltages on an integrated circuit comprising:

a first switch;

a circuit block;

a regulator circuit comprising a first transistor that provides current from a first supply voltage to the circuit block when the first switch is closed; and a second switch that provides current from a second supply voltage to the circuit block when the second switch is closed, wherein a first terminal of the second switch is coupled to a terminal of the first transistor, and a second terminal of the second switch is coupled to a node at the second supply voltage.

15. The system defined in claim 14 further comprising:

a second transistor coupled between the first transistor and the circuit block.

16. The system defined in claim 14 wherein the second switch comprises a second transistor coupled to receive the second supply voltage, and a third transistor coupled between first and second terminals of the second transistor.

17. The system defined in claim 14 wherein the second switch comprises a second transistor having a terminal coupled to receive the second supply voltage, and a third transistor coupled to a control input of the second transistor, wherein a control input of the third transistor is coupled to receive a switch signal.

18. The power management system defined in claim 9 wherein the second transistor is coupled between first and second terminals of the first transistor.

19. The power management system defined in claim 9 wherein the second transistor is coupled to a control input of the first transistor, and wherein a control input of the second transistor is coupled to receive a switch signal.

* * * * *